US005316566A

United States Patent [19]

Defays

[11] Patent Number: 5,316,566

[45] Date of Patent: May 31, 1994

[54] LIQUID STEEL BATH REHEATING METHOD

[75] Inventor: Jacques Defays, Neuville-en-Condroz, Belgium

[73] Assignee: Cockerill Sambre S.A., Seraing, Belgium

[21] Appl. No.: 949,820

[22] PCT Filed: Jun. 28, 1991

[86] PCT No.: PCT/BE91/00044

§ 371 Date: Dec. 10, 1992

§ 102(e) Date: Dec. 10, 1992

[87] PCT Pub. No.: WO92/00391

PCT Pub. Date: Jan. 9, 1992

[30] Foreign Application Priority Data

Jun. 29, 1990 [BE] Belgium ..... 9000673

[51] Int. Cl.[5] ..... C21C 5/52

[52] U.S. Cl. ..... 75/10.39

[58] Field of Search ..... 75/10.39

[56] References Cited

U.S. PATENT DOCUMENTS 4,200,452 4/1980 Savov ..... 75/10.39

*Primary Examiner*—Peter D. Rosenberg

*Attorney, Agent, or Firm*—Chilton, Alix & Van Kirk

[57] ABSTRACT

A method for metallothermally reheating a liquid steel bath in a metallurgical container into which a metal fuel is placed and oxidizing and agitating gases are injected under its surface. A controllable flow resulting from the injection of agitating gas is generated in the bath by means of a device which is separate from the oxidizing gas injection device, and the metal fuel is inserted into said flow so that it comes into contact with said oxidizing gas.

12 Claims, 2 Drawing Sheets

LIQUID STEEL BATH REHEATING METHOD

SUBJECT OF THE INVENTION

The present invention relates to a method for reheating a liquid steel bath contained in a metallurgical vessel.

TECHNOLOGICAL BACKGROUND

In the event of an accidental interruption in the running of the metallurgical process, between the smelting of the steel in the converter and the solidification operation, the liquid steel bath contained in a metallurgical vessel cools down and it is conventional to have to reheat it in order to permit the subsequent normal continuation of the process.

Such a bath can be reheated using a flame or electrically.

Various methods are also known which involve metallothermy, according to which methods a metallic fuel, for example aluminum, is introduced into the liquid steel bath and put into contact with an oxidizing agent, for example gaseous oxygen. The reaction between the combustible metal and the oxidant is exothermic, and the heat obtained is used for reheating the bath.

DESCRIPTION OF THE PRIOR ART

A vessel containing a liquid steel bath, which is reheated by using an aluminothermic method and by injecting stirring gas, is known from U.S. Pat. No. 4,761,178 and its equivalent, the application WO 89/01984.

A single consumable lance injects, under the liquid steel, oxidizing agents, especially gaseous oxygen, and an inert gas which are introduced, separately or as a mixture, at a depth of from 15 to 40% of the bath, by a plurality of parallel channels. Moreover, aluminum is introduced into the bath as close as possible to the point of oxygen injection.

It has been observed that the introduction of such a lance at this depth caused a significant amount of wear thereof. In addition, the reheating of the lower and the heat obtained is used for reheating the bath.

DESCRIPTION OF THE PRIOR ART

A vessel containing a liquid steel bath, which is reheated by using an aluminothermic method and by injecting stirring gas, is known from U.S. Pat. No. 4,761,178 and its equivalent, the application WO 89/01984.

A single consumable lance injects, under the liquid steel, oxidizing agents, especially gaseous oxygen, and an inert gas which are introduced, separately or as a mixture, at a depth of from 15 to 40% of the bath, by a plurality of parallel channels. Moreover, aluminum is introduced into the bath as close as possible to the point of oxygen injection.

It has been observed that the introduction of such a lance at this depth caused a significant amount of wear thereof. In addition, the reheating of the lower part of the bath is not particularly effective, as movements there are not very significant and the liquid steel is homogeneous neither in terms of temperature nor in terms of cleanliness with regard to inclusion.

A device is also known, from Document EP-A-0,352,254, for reheating a liquid steel bath during the filling of a metallurgical vessel via the top. This bath is covered by a slag rich in iron oxide. A metal or an alloy capable of reacting with the iron oxide of the slag and the oxides of the bath on the one hand, and an inert gas on the other hand, are injected, during the filling of the ladle, via its bottom. Furthermore, the reheating is completed by the presence of a burner in the region of the lid of the ladle.

Such a device does not provide for direct injection of oxidizing gas into the steel bath and is not intended to be used for reheating steel contained in a ladle which is already filled.

Document JP-A-5989708 describes a method according to which a current in a liquid steel bath is induced. An oxygen lance is introduced in the bath, and a stirring gas is injected in the bottom of the vessel by a porous brick located just in front of the oxygen lance. Uncontrollable turbulences in the steel, an imperfect distribution of the fuel and consequently a relatively low efficiency have been observed.

Finally, a ladle is known, from U.S. Pat. No. 486,935, containing liquid steel above the surface of which a bell is placed enclosing a non-consumable lance.

OBJECTS OF THE INVENTION

The object of the present invention is to provide a perfectly controlled metallothermic method for effectively reheating a liquid steel bath already contained in a ladle.

Its object is also to provide a particularly cost-effective method which make it possible to use, for this purpose, a consumable lance placed inside a liquid bath, whilst considerably reducing the wear and the risks of breakdown.

Another object of the invention is to provide a method in which the efficiency, relating to the consumption of oxygen and of combustible metal, is constant and better than in the known methods of the prior art.

An additional object of the invention is to provide a method making it possible to obtain a highly homogeneous distribution of the metallic fuel and, consequently, of the temperature in the liquid steel bath, in a satisfactory period of time, and by using simple and cost-effective means.

A further object of the invention is to provide a method by virtue of which a high purity of the liquid steel bath can easily be obtained.

A final object of the invention is to provide a method by virtue of which there is virtually no release of smoke above the bath and which does [sic] not add pollution to the environment.

SUMMARY OF THE INVENTION

The subject of the invention is a method for metallothermically reheating a liquid steel bath contained in a metallurgical vessel, into which a metallic fuel is introduced and beneath the surface of which an oxidizing gas and a stirring gas are injected.

According to the invention, a controllable current, resulting from the injection of a stirring gas via a means separate from the means for injecting the oxidizing gas, is created in the bath and the metallic rature in the liquid steel bath, in a satisfactory period of time, and by using simple and cost-effective means.

A further object of the invention is to provide a method and a device by virtue of which a high purity of the liquid steel bath can easily be obtained.

A final object of the invention is to provide a method and a device by virtue of which there is virtually no release of smoke above the bath and which does not add pollution to the environment.

SUMMARY OF THE INVENTION

The subject of the invention is a method for metallothermically reheating a liquid steel bath contained in a metallurgical vessel, into which a metallic fuel is introduced and beneath the surface of which an oxidizing gas and a stirring gas are injected.

According to the invention, a controllable current, resulting from the injection of a stirring gas via a means separate from the means for injecting the oxidizing gas, is created in the bath and the metallic fuel is introduced into this current, so that it is brought into contact with the oxidizing gas.

Preferably, the injection of the stirring gas generates an ascending current in the liquid steel, this current becoming descending at the location of injection of the oxidizing gas.

The axes of injection of the stirring gas and of the oxidizing gas may be offset with respect to each other, and for example may be parallel to each other. They may also be, in this case, perpendicular to the surface of the steel bath.

It has been found that the efficiency of the exothermic oxidation reaction for given quantities of oxidizing gas and of fuel was thus improved and that an excellent distribution of the temperature in the bath was obtained.

This manner of proceeding enables, in fact, the fuel to be distributed more uniformly, the separation of the products of the reaction to be improved and the temperature of the liquid steel bath to be made uniform, by promoting the exothermic reaction throughout the whole bath.

In addition, the currents of liquid steel thus generated entrain impurities constituted especially by the reaction products which may lead to inclusions, towards the upper part of the bath, more particularly scoria.

Preferably, the injection of the stirring gas generates an ascending current in the liquid steel, this current becoming descending at the location of injection of the oxidizing gas.

The axes of injection of the stirring gas and of the oxidizing gas may be offset with respect to each other, and for example may be parallel to each other. They may also be, in this case, perpendicular to the surface of the steel bath.

According to a preferred embodiment of the invention, the relative positions of the axes of injection of the stirring gas and of the oxidizing gas and that of the metallic fuel may be defined as follows: the injection of the stirring gas generates a theoretical metal suction cone, the apex of which is at the location where the injection takes place. Its generatrix extends the injection axis; its conicity is a function of the flow rate of the gas, and of the height of liquid steel in the metallurgical vessel. This cone has a base defining, on the surface of liquid steel, a theoretical circle, the dimensions of which may be calculated.

The oxidizing gas reacts with the fuel in a substantially spherical zone. It is possible to define, on the surface of the steel bath, a second corresponding theoretical circle, the oxidizing-gas injection axis of which constitutes the centre and the dimensions of which may be calculated.

The two theoretical circles generated respectively by the injection of the stirring gas and by the injection of the oxidizing gas overlap partially, thereby defining between them an intersection zone into which the metallic fuel, preferably aluminum in the form of wire, is introduced.

The metallic fuel is preferably introduced into the intersection zone at a point of intersection between the circumferences of the two theoretical circles.

As an addition, a second lance submerged at a great depth, preferably more than 60% of the height of the bath.

In order to start up the process for reheating the steel, the following steps are preferably started in succession:

the injection of the stirring gas, the introduction of the metallic fuel into the generated current, the injection of the oxidizing gas which reacts with the metallic fuel.

DESCRIPTION OF A PREFERRED EMBODIMENT

Figures 1, 2:
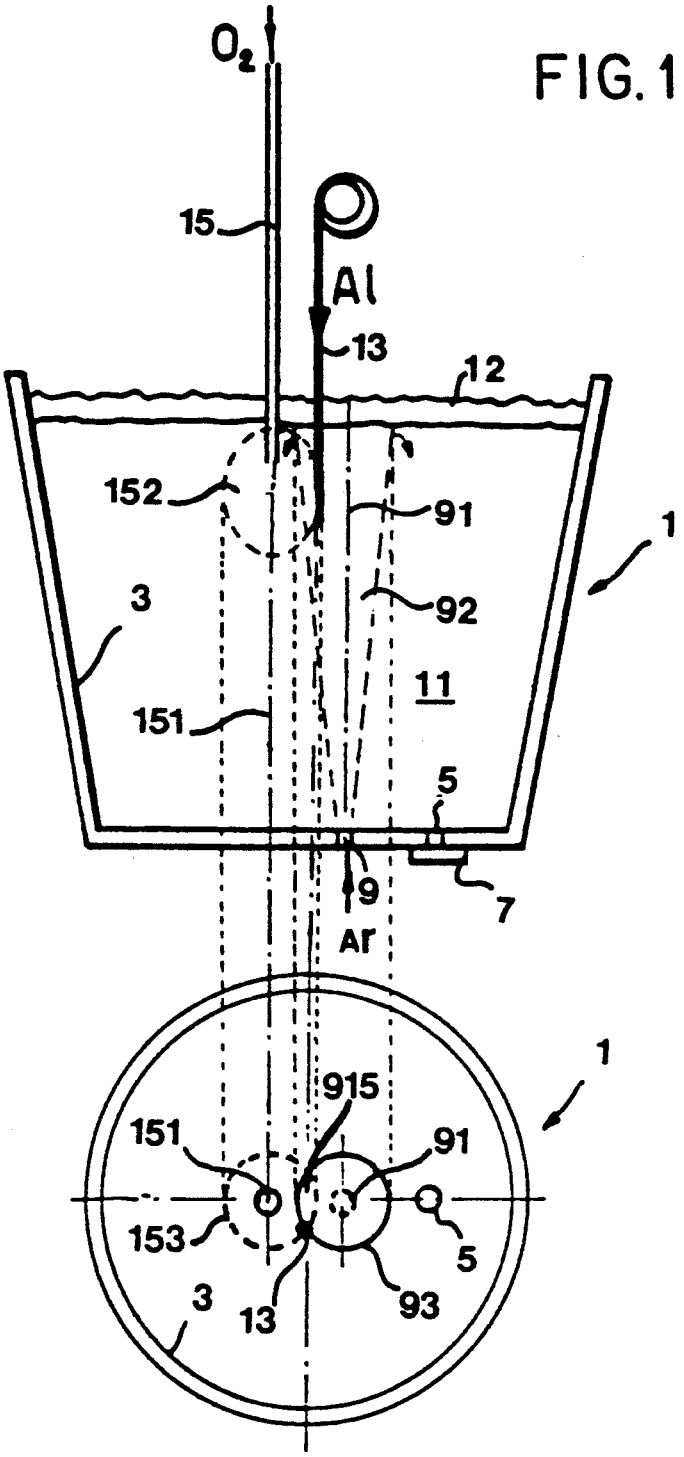
FIG. 1 is a view in elevation of a diagrammatic cross section of a pouring ladle.
FIG. 2 is a diagrammatic plan view of the latter.

FIGS. 1 and 2 represent a metallurgical vessel, such as for example a pouring ladle 1, lined with a refractory material 3 and having, at its lower part, a tap hole 5 fitted with an item of equipment 7 for opening and closing said hole.

A stirring gas, in this case argon, is injected via a porous element 9 placed in the bottom of a pouring ladle 1. The injection axis 91 constitutes the generatrix of a metal suction cone 92. The argon rises to the surface of the bath 11 and is then discharged freely into the atmosphere. The base of the cone 92 is located in the region of the surface of the bath. It has the shape of a circle 93 and is represented by a continuous line in FIG. 2.

An aluminum wire 13, serving as metallic fuel, is introduced into the bath 11.

This fuel will react with the oxygen which will next be injected into the bath. The reaction is strongly exothermic and will be advantageously used for reheating the bath effectively and rapidly and thereby obtaining an excellent distribution of the temperature by virtue of the relative arrangement of the various elements.

The oxygen is injected by a consumable lance 15, made from refractory material, which is plunged into the liquid steel bath 11 to a depth which can range from 0 to 15% of the height of the bath, taken as beneath the scoria zone 12 present at the surface.

Maintaining the immersion depth of the lance 15 is advantageously controlled by means known per se and adapted as a function of the average wear rate of the lance.

It is possible to define a theoretical axis 151 of injection of the oxidizing gas into the liquid steel bath, this axis being located in the extension of the consumable lance 15.

As seen in FIG. 1, the stirring gas entrains the aluminum in the descending movement which it imposes on the liquid steel close to the surface of the bath 11, and brings it close to the end of the lance 15 for injecting the oxidizing gas. It reacts exothermically with the latter.

The reaction takes place in a substantially spherical zone 152, the dimensions of which depend on the flow rate of the oxidizing gas, on its purity and on the local concentration of combustible metal.

It is therefore possible, when the flow rates for introducing the fuel and the oxidizing gas are substantially constant and in the combustion ratio, to calculate the diameter of a sphere at the periphery of which all the oxygen has reacted. In FIG. 1 a reaction zone 152 is shown which has a substantially ellipsoidal shape. The ellipsoidal nature is more or less pronounced depending on the value of the flow rate of the oxidizing gas.

As will be seen in more detail hereinbelow, the fuel and the oxidizing gas are introduced with a slight time delay, which is taken into account in the calculation.

Moreover, it is possible to represent, on the surface of the bath, a second theoretical circle 153, the center of which corresponds to the axis of injection of the oxidizing gas and the diameter of which is that of the sphere. Such a circle is represented by the dotted line in FIG. 2. It may also be defined in the case of an ellipsoidal reaction zone.

The diameter of the circle 93 defined by the base of the cone generated by the stirring gas may be determined precisely. Studies give a value of approximately 10° for the half-angle at the apex of the cone 92.

As a function of this datum, of the flow rate of the gas and of the average value of the height of the bath 11 in the ladle, an excellent approximation of the dimensions of the circle 93 is obtained.

As FIG. 2 clearly shows, the circles 93 and 153 define between them an intersection zone 915 into which the aluminum wire 13 is introduced, preferably at one of the points of intersection between the two circumferences. This arrangement enables a maximum efficiency and an excellent distribution of the temperature in the bath to be obtained.

Figure 3:
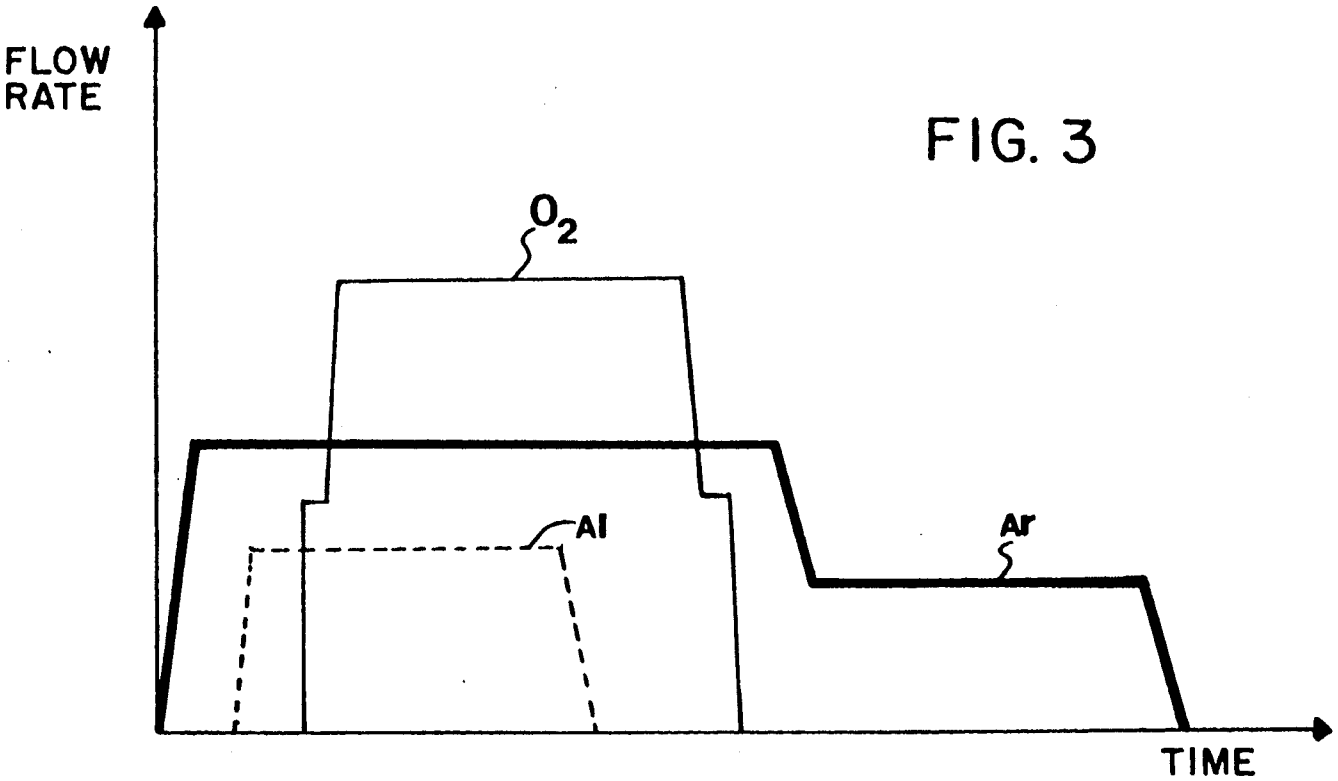
FIG. 3 is a diagram representing the running of a reheating operation according to the method of the invention.

FIG. 3 illustrates the running of an operation for reheating a liquid steel bath according to the method of the invention.

The graph shows the change over time of the flow rates of the stirring gas, in this case argon (Ar), of the fuel, in this case aluminum (Al) and of the oxidizing gas, in this case oxygen ($O_2$).

In order to start up the reheating of the molten bath, the injection of the stirring gas is started, then the metallic fuel wire is introduced and finally the oxygen injection is started.

The descending current induced by the stirring gas continuously brings, close to the point of injection of the oxidizing gas, new quantities of liquid steel loaded with aluminum, which reacts with the oxygen. A rotating motion is generated in the bath and enables, especially, the scoria to be removed.

Of course, the stirring then continues in the bottom of the ladle and the liquid steel thus reheated is distributed in the middle and top zones, which enables, at the end of the operation, a perfect distribution of the heat to be obtained throughout the whole bath.

The injections are continued until the desired temperature is obtained. Once this temperature has been reached, the oxygen lance is withdrawn whilst maintaining a small flow rate until this lance is out of the bath, thus preventing insufflation-pipe blockage. The stirring by the neutral gas is also maintained for some time so as to promote the elimination of the impurities resulting from the reaction as well as the debris due to the erosion of the lance.

It is of course clear that the invention is not limited to the embodiments described but that it is encompassed by the scope defined by the claims.

Thus, for example, according to another variant, it is possible to provide an additional stirring-gas injection lance instead of or in addition to the porous element 15.

It is further possible to use oxidizing gases other than pure oxygen, stirring gases other than argon and metallic fuels other than aluminum.

I claim:

1. In a method for metallothermically reheating a liquid steel bath (11) contained in a metallurgical vessel (1) and having a scoria zone at its surface, comprising the steps of introducing into the bath a metallic fuel and injecting below the surface of the bath an oxidizing gas and a stirring gas, wherein a current resulting from the injection of a stirring gas is created in the bath (11), via a means (9) separate from means (15) for injecting the oxidizing gas and wherein the metallic fuel (13) is introduced into the current, so that it is brought into contact with the oxidizing gas, the combination wherein the axes of injection of the oxidizing gas and of the stirring gas are out of alignment with respect to each other, and the injection of the stirring gas generates an ascending current in the liquid steel bath, this current becoming descending at the location of injection of the oxidizing gas.

2. Method according to claim 1, wherein the oxidizing gas is injected at a depth of 0 to 15% of the height of the liquid steel bath contained in the metallurgical vessel.

3. Method according to claim 1 wherein the stirring gas is injected at a depth of more than 60% of the height of the bath.

4. Method according to claim 1 wherein the axis (91) of injection of the stirring gas and the axis (151) of injection of the oxidizing gas are parallel to each other.

5. Method according to claim 4, wherein the axes (91, 151) are perpendicular to the surface of the bath (11).

6. Method according to claim 1, wherein the injection of the stirring gas generates a theoretical metal suction cone (92), the apex of which is at the location where the injection takes place, the generatrix of which extends the injection axis (91) and the base of which defines, on the surface of the bath (11), a mixing circle (93), and wherein the oxidizing gas reacts with the fuel (13) in a substantially spherical zone (152), the projection of which onto the surface of the bath 911) defines a reaction circle (153) and wherein the mixing and reaction circles (93, 153) overlap partially, thereby defining an intersection zone (915) into which the fuel (13) is introduced.

7. Method according to claim 6, wherein the metallic fuel (13) is introduced into the intersection zone (915) at a point of intersection between the circumferences of the mixing and reaction circles (93, 153).

8. Method according to claim 1, wherein the following steps are started in succession:

the injection of the stirring gas, the introduction of the metallic fuel into the generated current, the injection of the oxidizing gas which reacts with the metallic fuel.

9. The method of claim 2 wherein the oxidizing gas is injected at a depth of between 3 and 30 cm.

10. The method of claim 6 wherein the metallic fuel is aluminum.

11. The method of claim 10 wherein the aluminum fuel is in the form of wire.

12. The method of claim 1 wherein the metallic fuel is aluminum.

* * * * *